350-96.21
1/6/81 XR 4,243,332

United States Patent [19]
Hartmann

[11] 4,243,332
[45] Jan. 6, 1981

[54] ELECTRODE GUIDE

[75] Inventor: Kurt Hartmann, Calw-Heumaden, Fed. Rep. of Germany

[73] Assignee: International Business Machines Corporation, Armonk, N.Y.

[21] Appl. No.: 51,770

[22] Filed: Jun. 25, 1979

[30] Foreign Application Priority Data

Aug. 9, 1978 [DE] Fed. Rep. of Germany ..... 2834868

[51] Int. Cl.[3] ..... B41J 3/20
[52] U.S. Cl. ..... 400/119; 101/377; 24/256; 24/257; 403/391; 269/22; 269/902; 350/96.21
[58] Field of Search ..... 400/118, 119; 101/377, 101/169, 415.1; 24/256, 257; 403/391, 400; 269/43, 22, 321 WE, 321 N, 254 R; 350/96.21

[56] References Cited

U.S. PATENT DOCUMENTS

| | | | |
|---|---|---|---|
| 1,566,358 | 12/1925 | White | 101/169 |
| 3,058,417 | 10/1962 | Norlin | 101/415.1 |
| 3,187,718 | 6/1965 | Coghill | 101/169 |
| 3,715,981 | 2/1973 | Huffman | 101/415.1 |
| 3,826,484 | 7/1974 | Check et al. | 269/321 N |
| 3,885,859 | 5/1975 | Dalgleish et al. | 350/96.21 |
| 4,046,454 | 9/1977 | Pugh | 350/96.21 |
| 4,088,312 | 5/1978 | Frosch et al. | 269/266 |

*Primary Examiner*—William Pieprz
*Attorney, Agent, or Firm*—Kenneth P. Johnson

[57] ABSTRACT

Guide for electrodes in a metal paper printer comprising a multipart arrangement of a guide portion, with parallel grooves for the electrodes, and of a cover portion assembled to the guide portion. The cover portion has a recess extending transversely of the electrodes and retains an elastic, nonconductive, and deformable tube frictionally restraining the electrodes, yet allowing electrode advancement as required.

3 Claims, 3 Drawing Figures

ELECTRODE GUIDE

BACKGROUND OF THE INVENTION

The invention relates to a precision guide for electrodes for a multiple electrode print head in a metal paper printer.

Multiple electrode print heads for metal paper printers are known in a great variety of designs. Their object is to ensure a specific mutual spacing of the electrodes and, as far as wear problems of the electrodes have to be considered, to provide means for advancing the electrodes.

It has, for example, been suggested in German patent application of Ser. No. P 26 52 033.2 to construct a print head having a number of small glass tubes cast in a synthetic material, each guiding one electrode. Such an electrode guide system has the disadvantage of high manufacturing costs and complicated insertion of the electrodes into the individual glass tube guides.

OBJECT AND SUMMARY OF THE INVENTION

It is therefore the object of this invention to provide a precision electrode guide which can be made simply and with low costs, and in which electrodes can be readily inserted.

The foregoing and other objects, features and advantages of the invention will be apparent from the following more particular description of a preferred embodiment of the invention, as illustrated in the accompanying drawing.

DESCRIPTION OF THE PREFERRED EMBODIMENT

Figure 1:
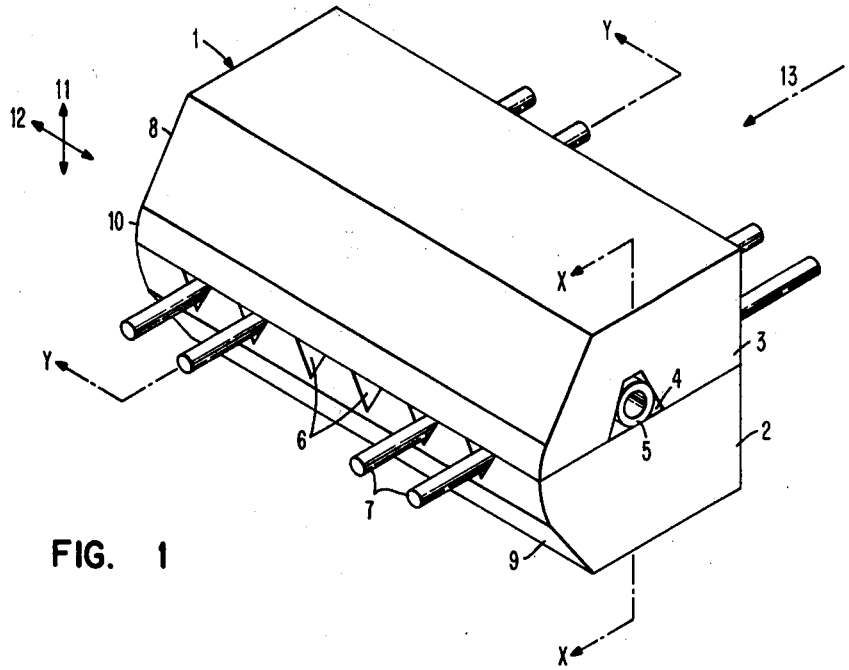
FIG. 1 is a schematic perspective view of the precision guide.

In FIG. 1, precision guide 1 consists of three main parts: a guide part 2, a cover 3, and a flexible fixing tube 5 in a recess 4 of cover 3. Guide part 2 is equipped with a number of adjacent guide grooves 6 containing electrodes 7. To show the design more clearly some of these guide grooves are represented without their electrodes. Cover 3 and guide part 2 are beveled (8, 9) toward the printing side. The thus formed actual mouthpiece 10 of this precision guide is designed in a manner advantageous for the printing process, i.e. it is slightly rounded off in printing direction (direction of double arrow 11) and perpendicularly thereto (direction of double arrow 12) to ensure smooth gliding, and to prevent the adhering of printing residues and dirt. Both parts, cover 3 as well as guide part 2 are fixed in their external position by respective stops and supports (not shown). Cover 3 can be fixed on guide part 2 by means of simple screws engaging in this cover. Other fixing and mounting means are also possible.

This precision guide can be used in particular in a device for the advance of electrodes as described in German patent application P 27 58 150.6. When the electrodes have worn off, they can be advanced along groove 6 in the direction of dash-line arrow 13. The device for advancing these electrodes is not the subject of the present invention and will therefore not be described in detail.

Figure 2:
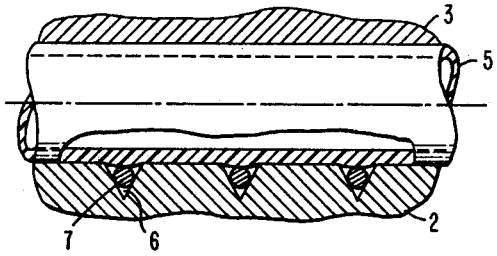
FIG. 2 is an enlarged part-sectional view of the precision guide according to FIG. 1, along sectional line XX.
Figure 3:
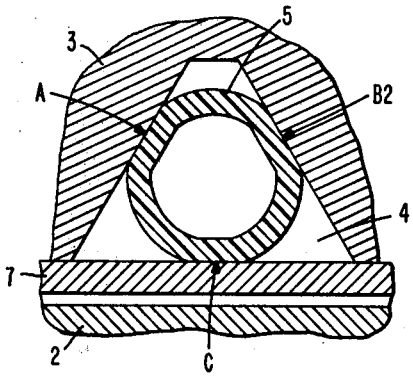
FIG. 3 is an enlarged sectional view of the precision guide along sectional line Y for showing the position of an electrode in connection with a tubular holding part placed transversely thereto.

For keeping electrodes 7 in a fixed position, since they move relatively loosely in grooves 6, a flexible holding tube 5 is provided which is placed in a recess 4 of the cover. This recess is preferably of a prismatic shape and extends transversely to the electrode direction. Within recess 4 is an elastic flexible holding tube 5 of electrically nonconductive material, preferably a suitable, low friction plastic material. This tube is dimensioned in such manner that, when assembled within the precision guide, it is deformed at points A, B and C, as seen in FIG. 3. In this manner, the lower part of the plastic tube (deformation area C) acts on electrode 7 in guiding groove 6 and maintains it in a fixed position without any lateral tolerance, as in FIG. 2. It thus insures that electrodes 7 are guided in their respective grooves 6 without any lateral tolerance.

In addition, the flexible holding tube permits the advance of the electrodes in the assembled state of the precision guide because of the low friction surface characteristics of the plastic tube. Guide part 2 and cover 3, for obvious reasons, consist of a nonconductive material so that the individual electrodes remain insulated from each other. Ceramics are a preferred material for that purpose, but there also exist other possible solutions where electrically conductive metals are rendered nonconductive through corresponding surface treatment in their surface area. FIG. 2 shows an enlarged partial sectional view of the precision guide in accordance with FIG. 1 following sectional line XX. This representation shows the position of the individual electrodes 7 within their guide grooves 6. These guide grooves have a simple triangular configuration. Tube 5 is slightly pressed into these grooves in contact with electrodes 7 in their upper part and thus fix the electrodes in position within the grooves.

Models of this precision guide have been built and successfully tested. The tests have shown that they are particularly useful in metal paper printers of high print resolution, i.e. for very thin electrodes. Their manufacturing costs are only a fraction of the costs for conventional print heads, and the process of threading the individual electrodes into the guides is less complex than with conventional print heads. This is due to the multipart structure of this precision guide. Furthermore, tests have shown that, with precision guides used according to the invention, the print quality is the same as that obtained with conventional print heads.

While the invention has been particularly shown and described with reference to a preferred embodiment thereof, it will be understood by those skilled in the art that various changes in form and details may be made therein without departing from the spirit and scope of the invention.

Having thus described my invention, what I claim as new, and desire to secure by Letters Patent is:

1. A guide for electrodes in a metallized paper printer comprising:

support means having a plurality of parallel grooves in a first surface thereof in which electrodes may be placed;

cover means having a second surface overlying said first surface in mutual contact therewith enclosing the grooves thereof, said cover means having a recess in said second surface transversely of said grooves; and a resilient tubular element in said recess deformable by the joining of said first and second surfaces to extend into said grooves and engage any electrodes therein.

2. Apparatus as described in claim 1 wherein said resilient element is an electrically nonconductive plastic material having a low friction surface.

3. Apparatus as described in claim 1 wherein said recess has a prismatic cross-section and said resilient element is deformed by two surfaces of said recess in conjunction with said first surface.

* * * * *